US011440773B2

(12) United States Patent
Herkel

(10) Patent No.: US 11,440,773 B2
(45) Date of Patent: Sep. 13, 2022

(54) AUTOMATIC RESCUE OPERATION IN AN ELEVATOR SYSTEM

(71) Applicant: Otis Elevator Company, Farmington, CT (US)

(72) Inventor: Peter Herkel, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 798 days.

(21) Appl. No.: 16/354,580

(22) Filed: Mar. 15, 2019

(65) Prior Publication Data

US 2019/0284022 A1 Sep. 19, 2019

(30) Foreign Application Priority Data

Mar. 16, 2018 (EP) ..... 18162168

(51) Int. Cl.
*B66B 5/02* (2006.01)
*B66B 5/28* (2006.01)
(Continued)

(52) U.S. Cl.
CPC ..... *B66B 5/02* (2013.01); *B66B 1/28* (2013.01); *B66B 1/3407* (2013.01);
(Continued)

(58) Field of Classification Search
CPC ..... B66B 5/0031; B66B 5/027; B66B 5/02; B66B 1/32; B66B 5/18; B66B 5/021;
(Continued)

(56) References Cited

U.S. PATENT DOCUMENTS 6,173,814 B1 1/2001 Herkel et al.
6,364,066 B1 * 4/2002 Bolch ..... B66B 5/0018 187/391
(Continued)

FOREIGN PATENT DOCUMENTS

CN 1218001 A 6/1999
CN 1221703 A 7/1999
(Continued)

OTHER PUBLICATIONS

Kone Corporation, "Monitor and Control Your Elevators and Escalators", available at: https://www.kone.fi/Images/KONE%20E-Link_tcm36-18662.pdf, accessed Mar. 14, 2019, 8 pages.
(Continued)

*Primary Examiner* — Marlon T Fletcher
(74) *Attorney, Agent, or Firm* — Cantor Colburn LLP

(57) ABSTRACT

An automatic elevator safety system includes an elevator safety circuit and an external server. The elevator safety circuit is configured for monitoring the operation of an elevator system comprising at least one elevator car traveling along a hoistway, and an elevator control configured for controlling the movement of the elevator car. At least one of the elevator control and the elevator safety circuit is configured for sending data comprising information about the current state of the elevator system to the external server, in particular in case a safety issue has been detected. The external server is configured for (A) receiving the data sent by the at least one elevator safety circuit; (B) analyzing the received data; and (C) depending on the result of the analysis, sending commands to the elevator system.

11 Claims, 2 Drawing Sheets

Figure 1:
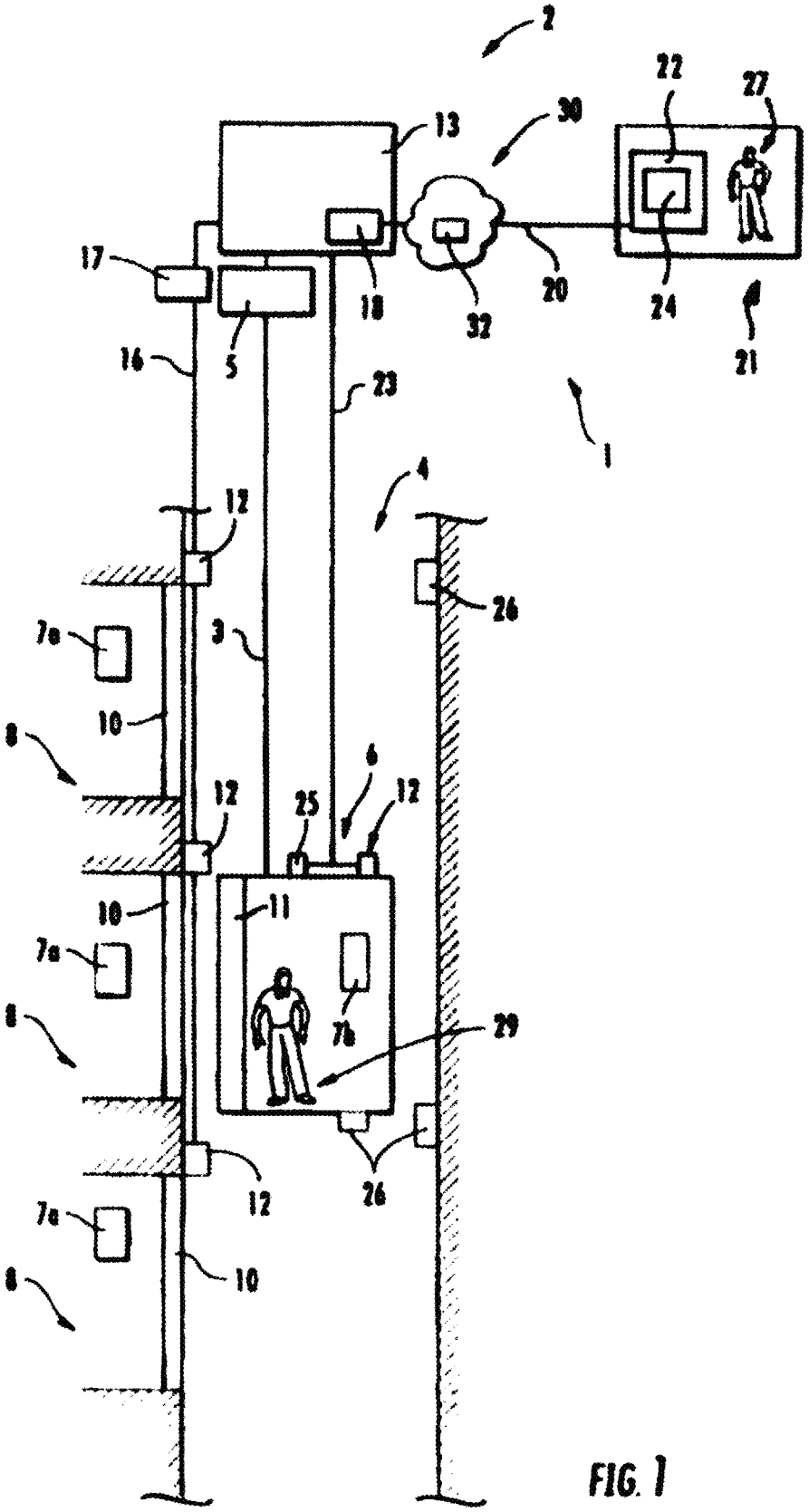

(51) Int. Cl.
*B66B 1/28* (2006.01)
*B66B 1/34* (2006.01)
*B66B 5/00* (2006.01)

(52) U.S. Cl.
CPC ..... *B66B 1/3461* (2013.01); *B66B 5/0031* (2013.01); *B66B 5/027* (2013.01); *B66B 2201/40* (2013.01)

(58) Field of Classification Search
CPC ..... B66B 5/00; B66B 1/3415; B66B 5/022; B66B 1/40; B66B 5/028
See application file for complete search history.

(56) References Cited

U.S. PATENT DOCUMENTS

| | | | | |
|---|---|---|---|---|
| 7,434,664 | B2 | 10/2008 | Helstrom | |
| 7,448,473 | B2 | 11/2008 | Lindberg et al. | |
| 8,069,958 | B2 | 12/2011 | Lence-Barreiro | |
| 9,580,276 | B2 * | 2/2017 | Toutaoui | B66B 5/0087 |
| 9,747,585 | B2 | 8/2017 | Eleid et al. | |
| 2011/0302466 | A1 * | 12/2011 | Ikawa | B66B 5/0031 714/704 |
| 2017/0341906 | A1 * | 11/2017 | Muller | B66B 5/0031 |
| 2018/0237261 | A1 * | 8/2018 | Herkel | B66B 5/02 |
| 2018/0251337 | A1 * | 9/2018 | Matsueda | B66B 5/0087 |
| 2019/0100407 | A1 * | 4/2019 | Miyajima | B66B 5/027 |
| 2019/0210837 | A1 * | 7/2019 | Herkel | B66B 1/3461 |
| 2019/0284022 | A1 * | 9/2019 | Herkel | B66B 5/027 |
| 2019/0322485 | A1 * | 10/2019 | Kattainen | B66B 5/02 |
| 2020/0031620 | A1 * | 1/2020 | Herkel | B66B 1/3461 |
| 2021/0171315 | A1 * | 6/2021 | Kattainen | B66B 3/002 |
| 2021/0171318 | A1 * | 6/2021 | Kattainen | B66B 1/3461 |

FOREIGN PATENT DOCUMENTS

| | | | |
|---|---|---|---|
| CN | 1351571 | A | 5/2002 |
| CN | 101037167 | A | 9/2007 |
| CN | 104355196 | A | 2/2015 |
| CN | 103640944 | A | 6/2016 |
| CN | 107555279 | A | 1/2018 |
| EP | 1454866 | A2 | 9/2004 |
| EP | 1880967 | A1 | 1/2008 |
| EP | 2336070 | A1 | 6/2011 |
| EP | 1809560 | B1 | 4/2012 |
| EP | 2927174 | A1 | 10/2015 |
| EP | 1852382 | B1 | 12/2015 |
| EP | 3184477 | A1 | 6/2017 |
| JP | H04235881 | A | 8/1992 |
| JP | 2002326776 | A | 11/2002 |
| JP | 2005047667 | A | 2/2005 |
| KR | 20080107900 | A | 12/2008 |
| KR | 20170114324 | A | 10/2017 |
| WO | 2015132447 | A1 | 9/2015 |
| WO | 2016113456 | A1 | 7/2016 |
| WO | 2018001830 | A1 | 1/2018 |

OTHER PUBLICATIONS

European Search Report for application EP 18162168, dated Sep. 6, 2018, 30 pages.
Chinese Office Action and Search Report for application CN 2019101973951, dated May 15, 2020, 12 pages.

* cited by examiner

AUTOMATIC RESCUE OPERATION IN AN ELEVATOR SYSTEM

The invention relates to a method of performing an automatic rescue operation of an elevator system and to an elevator safety system configured for performing such an automatic rescue operation. The invention further relates to an elevator system comprising such an elevator safety system.

An elevator system comprises at least one elevator car traveling along a hoistway between a plurality of landings. In case of a malfunction, the elevator car may stop at a position within the hoistway between the landings. As a result, passengers may be trapped within the elevator car. In order to free the passengers, a qualified mechanic has to visit the site for operating the elevator system in a manual emergency rescue operation. Waiting for the mechanic for being released from the elevator car is unpleasant for the passengers trapped within the elevator car.

It therefore would be desirable to provide a method of performing an emergency rescue operation which allows freeing the passengers more quickly. It also would be desirable to provide an elevator safety system/elevator system which is able to perform such a method.

According to an exemplary embodiment of the invention, a method of performing an automatic rescue operation of an elevator system comprises: (A) detecting a safety signal indicating a safety issue within the elevator system; (B) sending data comprising information about the current state of the elevator system to an external server, the external server in particular being provided spatially separated from the elevator system and/or connected to a plurality of elevator systems located at various locations; (C) analyzing the transmitted data on the external server; and (D) depending on the result of the analysis, sending commands to the elevator system. The commands sent to the elevator system include instructing the elevator system (a) to ignore the safety issue and resume normal operation, (b) to operate the elevator system in a restricted rescue mode, or (c) to stop operating the elevator system. The method may further include generating an alarm signal instructing a mechanic to visit the elevator system in order to resolve the detected safety issue.

An automatic elevator safety system according to an exemplary embodiment of the invention includes an elevator safety circuit. The elevator safety circuit is configured for monitoring the operation of an elevator system comprising at least one elevator car traveling along a hoistway and an elevator control configured for controlling the movement of the elevator car. The automatic elevator safety system further comprises an external server, which in particular is spatially separated from the elevator system and/or connected to a plurality of elevator systems located at various locations. At least one of the elevator control and the elevator safety circuit is configured for sending data comprising information about the current state of the elevator system to the external server, in particular in case a safety issue has been detected. The external server is configured for (A) receiving the data sent by the at least one elevator safety circuit; (B) analyzing the received data; and (C) depending on the result of the analysis, sending commands to the elevator system. These commands include instructing the elevator system (a) to ignore the safety issue and to resume normal operation of the elevator system; (b) to operate the elevator system in a restricted rescue mode; or (c) to stop operation of the elevator system. The external server may further be configured for generating an alarm signal instructing a mechanic to visit the elevator system in order to resolve the detected safety issue.

Exemplary embodiments of the invention further include an elevator system equipped with an automatic elevator safety system according to an exemplary embodiment of the invention.

A method, an elevator safety system and an elevator system according to exemplary embodiments allow automatically resuming normal operation of the elevator system, or at least automatically freeing passengers trapped within an elevator car of the elevator system, after a safety issue has been detected. As there is no need for a mechanic to intervene, the elevator system may return to normal operation and/or the passengers may be freed faster than in conventional elevator systems, which need to be visited by a mechanic in order to free the passengers and to resolve the detected safety issue.

In consequence, in an elevator system according to an exemplary embodiment of the invention, the situation is more convenient for the passengers, the down-times of the elevator system may be reduced, and the costs for a mechanic visiting the elevator system may be saved.

A number of optional features are set out in the following. These features may be realized in particular embodiments, alone or in combination with any of the other features.

The at least one elevator safety circuit may comprise a safety chain including at least one (mechanical) safety switch and/or at least one electronic safety node. The data comprising information about the current state of the elevator system may include data indicating the state of the at least one safety switch and/or the at least one safety node. Such a configuration allows the automatic elevator safety system to cooperate with a safety chain as it is usually implemented in conventional elevator systems. Thus, an automatic elevator safety system according to an exemplary embodiment of the invention may be combined with existing elevator systems without the need for an excessive redesign or modification of the respective elevator system.

A method according to an exemplary embodiment of the invention may additionally comprise the following steps, which may be carried out before and/or after step (C): The external server requesting further information from the elevator system (E1); the elevator system sending additional data comprising further information to the external server (E2); and analyzing the additionally received data on the external server (E3).

These additional steps allow the external server to analyze the current state of the elevator system based on additional information received from the elevator system. The request for additional information may be based on the result of the analysis of the previously transmitted information. In consequence, the final analysis may be based on all relevant information available without transmitting unnecessary information from the elevator system to the external server.

The analysis of the received data may be based on a model of the elevator system. The model may be a numerical model, or another type of model, such as a state model, allowing an analysis of the behaviour and properties of the elevator system.

The model may be implemented on the external server, in particular on a programmable computer being part of the external server. The model particularly may be based on binary information provided by the elevator system, in particular the elevator control. Said binary information may comprise responses to questions which may be answered by yes or no, such as information such as whether hoistway doors and/or doors of the elevator car are open, whether the elevator system is performing a normal run and/or whether the safety switches are closed. Such a (numerical) model of the elevator system allows for a well-founded analysis of the current state of the elevator system. It further allows testing potential measures for solving detected safety issues by amending one or more input parameters of the model.

The model may be configured for transferring the elevator system from its current state, which is associated with a safety issue, into a state allowing normal operation or into a state allowing a restricted rescue operation of the elevator system. The model in particular may be configured for transferring the elevator system from its current state into at least one intermediate state.

Transferring the elevator system into another state may include transferring the elevator system through a chain of intermediate states. The method of performing an automatic rescue operation in particular may include checking whether the elevator system reaches the desired intermediate state(s) before sending the next command to the elevator system. Checking whether the elevator system reaches the desired intermediate state(s) ensures a controlled and secure transfer of the elevator system from its current (erroneous) state into a desired final state, i.e. a state allowing normal operation of the elevator system or a state which allows operating the elevator system in a restricted rescue mode.

The data transferred form the elevator system to the external server may comprise information about the current state of the elevator system. The data may include data indicating the state of at least one switch or at least one node of the elevator system, in particular of at least one safety switch or at least one safety node. Alternatively or additionally, the data transferred from the elevator system to the external server may comprise video information, in particular pictures taken by at least one camera located within the hoistway and/or at/within the elevator car. Such data allow for a detailed analysis of the current state of the elevator system.

The restricted rescue mode may include moving the elevator car with a reduced speed and/or over a limited distance, in particular moving the elevator car only to the nearest landing, and opening doors of the elevator car and of the hoistway as after the elevator car has reached said landing.

For example, in a situation in which the elevator car has moved some distance from a landing and at least one door is detected as not properly closed, the elevator car may be moved back to the landing with a reduced speed although at least one of the doors is not properly closed. This avoids passengers from being trapped within the elevator car. It further prevents passengers from being injured when trying to climb or jump out of an elevator car which is not positioned at one of the landings.

The external server may be configured for receiving and analyzing data from a plurality of elevator safety systems. Thus, in order to reduce the costs for implementing an automatic elevator safety system according to an embodiment of the invention, a single external server may be used in combination with a plurality of elevator safety systems/elevator systems.

In the following, an exemplary embodiment of the invention is described with reference to the enclosed figures.

FIG. 1 schematically depicts an elevator system comprising an automatic elevator safety system according to an exemplary embodiment of the invention.

Figure 2:
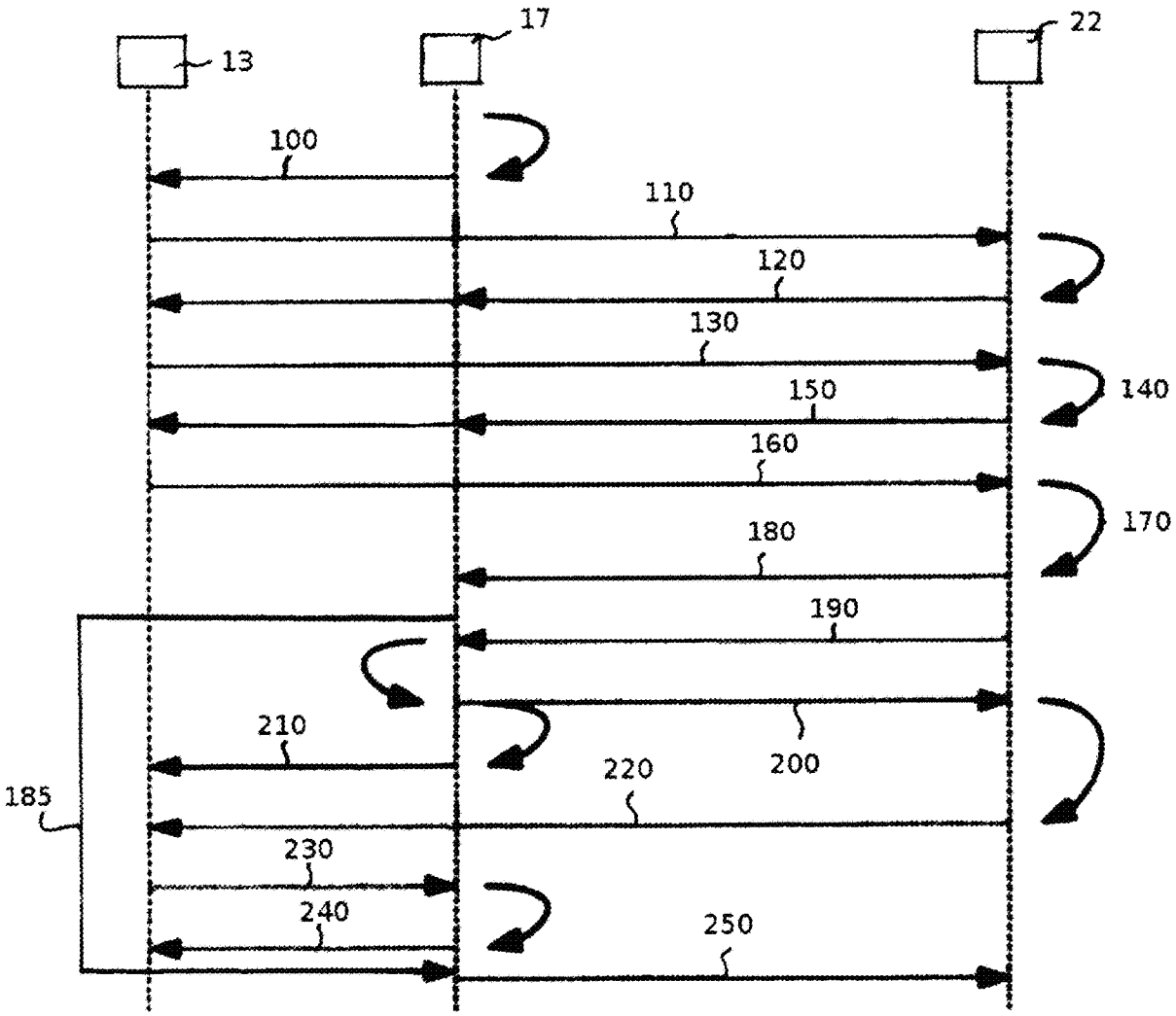

FIG. 2 schematically illustrates the steps of a method of performing an automatic rescue operation according to an exemplary embodiment of the invention.

FIG. 1 schematically depicts an elevator system 2 comprising an automatic elevator safety system 1, which is configured for performing an automatic emergency rescue operation according to an exemplary embodiment of the invention.

The elevator system 2 comprises an elevator car 6 movably suspended within a hoistway 4 extending between a plurality of landings 8 located on different floors.

The elevator car 6 is movably suspended by means of a tension member 3. The tension member 3, for example a rope or belt, is connected to a drive 5, which is configured for driving the tension member 3 in order to move the elevator car 6 along the height of the hoistway 4 between the plurality of landings 8.

Each landing 8 is provided with an elevator hoistway door (landing door) 10, and the elevator car 6 is provided with an elevator car door 11 allowing passengers 29 to transfer between a landing 8 and the interior of the elevator car 6 when the elevator car 6 is positioned at the respective landing 8.

The exemplary embodiment of the elevator system 2 shown in FIG. 1 employs a 1:1 roping for suspending the elevator car 6. The skilled person, however, easily understands that the type of the roping is not essential for the invention and that different kinds of roping, e.g. a 2:1 roping, may be used as well. The elevator system 2 may further include a counterweight (not shown) moving concurrently and in opposite direction with respect to the elevator car 6. Alternatively, the elevator system 2 may be an elevator system 2 without a counterweight, as it is shown in FIG. 1. The drive 5 may be any form of drive used in the art, e.g. a traction drive, a hydraulic drive or a linear drive. The elevator system 2 may have a machine room or may be a machine room-less elevator system. The elevator system 2 may use a tension member 3, as it is shown in FIG. 1, or it may be an elevator system without a tension member 3, comprising e.g. a hydraulic drive or a linear drive (not shown).

The drive 5 is controlled by an elevator control 13 for moving the elevator car 6 along the hoistway 4 between the different landings 8.

Input to the elevator control 13 may be provided via landing control panels 7*a*, which may include destination call panels, provided on each landing 8 close to the elevator hoistway doors 10, and/or via a car operation panel 7*b* provided inside the elevator car 6.

The landing control panels 7*a* and the car operation panel 7*b* may be connected to the elevator control 13 by means of electrical lines, which are not shown in FIG. 1, in particular by an electric bus, e.g. a field bus such as a CAN bus, or by means of wireless data connections.

For determining the current position of the elevator car 6, the elevator system 2 is provided with at least one position sensor 25 configured for detecting the current position (height) of the elevator car 6 within the hoistway 4. The position sensor 25 may also allow determining the speed of the movement of the elevator car 6.

The position sensor 25 is connected with the elevator control 13 via a signal line 23, or via a wireless connection (not shown) configured for transmitting the detected position of the elevator car 6 to the elevator control 13.

Cameras 26 may be arranged within the hoistway 14 and/or at the elevator car 6 for providing at least one picture of the interior of the hoistway 14.

A safety circuit 17 is configured for monitoring the safety of the elevator system 2. The safety circuit 17 particularly may be connected with a safety chain 16 comprising a plurality of safety nodes and/or safety switches 12. In case a safety issue, i.e. a malfunction which is relevant for the safety of the elevator system, occurs, at least one of the safety nodes/safety switches 12 interrupts the safety chain 16. As a result, the safety circuit 17 determines that a safety issue occurred and stops the movement of the elevator car 6. This is schematically illustrated as step 100 in FIG. 2. As a result, passengers 29 are trapped within the elevator car 6. As mentioned before, it is desirable to allow the trapped passengers 29 to leave the elevator car 6 as soon as possible.

At least in case a safety issue has been detected, a communication circuit 18 provided within, or connected with, the elevator control 13 establishes a data connection 20 between the elevator control 13 and an external server 22. The external server 22 may be provided spatially separated from the elevator system 2, e.g. in a remote service center 21.

The external server 22 may be configured for connecting with a plurality of elevator systems 2, in particular elevator systems 2 located at various locations.

The data connection 20 between the elevator system 2 and the external server 22 may be established via the Internet 30, in particular via a virtual private network (VPN) and/or via a virtual cloud 32 within the Internet. The data connection 20 may include a conventional telephone line or a digital line such as ISDN or DSL. It further may include wireless communication systems including WLAN, GMS, UMTS, LTE, Bluetooth® etc.

The steps following the establishment of the data connection 20 are schematically illustrated in the diagram depicted in FIG. 2.

A safety signal indicating the detected safety issue is transmitted from the elevator control 13 via the communication circuit 18 and the established data connection 20 to the external server 22 (step 110).

In response, the external server 22 requests information about the current state of the elevator system 2 (step 120). Data comprising the desired information are transferred from the elevator control 13 and/or from the safety circuit 17 to the external server 22 via the communication circuit 18 and the data connection 20 (step 130).

The data transmitted to the external 22 server may comprise information related to the state of individual safety nodes/safety switches 12, information about the current position and/or speed of the elevator car 6 and/or information about the current state of the doors 10, 11, in particular information whether the doors 10, 11 are open or properly closed.

The data may further comprise pictures of the hoistway 4 provided by the cameras 26 arranged within the hoistway 14 and/or at the elevator car 6.

The external server 22 analyzes the received data (step 140) for determining the severity of the detected safety issue and for identifying measures for resolving the detected safety issue.

If the external server 22 determines that additional information is needed, the external server 22 may request additional information, particularly more detailed information, about the current state of the elevator system 2, from the elevator control 13 and/or from the safety circuit 17 (step 150). In step 160 the requested information is delivered to the external server 22.

The external server 22 may analyze the received data using a model, in particular a numerical model or a state model, of the elevator system 2, implemented on the external server 22. The external server 22 may comprise a computer 24, allowing the model of the elevator system 22 to be implemented by a computer program running on said computer 24.

The model may be based on binary information provided by the elevator system 2, in particular the elevator control 13 and/or the safety circuit 17. Said binary information may include information such as whether the doors 10, 11 are open or properly closed, whether the elevator system 2 is performing a normal run or a special maintenance run, and/or whether the safety switches 12 are open or closed. n pieces of binary information result in $2^n$ possible states of the elevator system 2.

In case the current state of the elevator system is an "error state" resulting from a safety issue, the external server 22 tries to determine possible ways for transferring the elevator system from the current erroneous state into a state allowing normal operation of the elevator system 2 (step 170).

A possible result of said analysis may be instructing the elevator system 2 to ignore the safety issue and to resume normal operation (step 180). This e.g. may be the case when it is determined that the safety issue results from a temporary problem, such as a loose contact or a temporary overlap of control signals, which does not require taking any countermeasures and which does not prevent the elevator system 2 form being operated safely.

If it is determined that it is not possible to transfer the elevator system 2 into a state allowing normal operation by sending commands to the elevator system 2, the external server 22 tries transferring the elevator system 2 at least into a state which allows operating the elevator system 2 in a restricted rescue mode for freeing passengers 29 trapped within the elevator car 6.

In case the external server 22 determines that operating the elevator system 2 in a restricted rescue mode is possible, it sends a corresponding signal to the elevator system 2 (step 190). In response to receiving such a signal, the elevator system 2 confirms that it switches into a restricted rescue mode (step 200) and closes the safety chain 16 (step 210) in order to allow the elevator car 6 to move.

Operating the elevator system 2 in a restricted rescue mode may include moving the elevator car 6 only to the nearest landing 8 and opening the doors 10, 11 (step 220) after the elevator car 6 has reached the desired landing for allowing passengers 29 to leave the elevator car 6. In the restricted rescue mode, the elevator car 6 may be allowed to move only over a limited distance and/or only with a reduced speed compared to normal operation.

After the rescue run has been completed (step 230), the safety chain 16 is opened again (step 240), the operation of the elevator system 2 is stopped, and an alarm message is issued (step 250). The alarm message may request a qualified person, such as a mechanic 27, at the service center 21 to check the available information and to decide how to proceed further. This in particular may include that a mechanic 27 visits the elevator system 2 in order to remedy the detected malfunction.

In case it should not be possible to transfer the elevator system 2 into a state which allows operating the elevator system 2 in a restricted rescue mode, steps 190 to 240 are skipped (step 185), the operation of the elevator system 2 is stopped, and an alarm message requesting a qualified person to check the available information and to decide how to proceed further is issued (step 250). This in particular may include that a mechanic 27 visits the elevator system 2 in order to free passengers 29 trapped within the elevator car 6 and to remedy the detected malfunction.

Transferring the elevator system 2 from its current (erroneous) state into a state allowing normal operation or into a state allowing a restricted rescue operation of the elevator system 2 may include transferring the elevator system 2 from its current state into at least one intermediate state. Transferring the elevator system 2 in particular may include transferring the elevator system 2 through a chain of intermediate states. The external server 22 may check whether each intermediate state is reached before sending further commands for transferring the elevator system 2 into the next state. This ensures a controlled and secure transfer of the elevator system 2 from its current state into a desired final state.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention is not limited to the particular embodiments disclosed, but that the invention includes all embodiments falling within the scope of the claims.

REFERENCES

1 elevator safety system
2 elevator system
3 tension member
4 hoistway
5 drive
6 elevator car
7*a* landing control panel
7*b* car operation panel
8 landing
10 hoistway door
11 elevator car door
12 safety switch/safety node
13 elevator control
16 safety chain
17 safety circuit
18 communication circuit
20 data connection
21 service center
22 external server
23 signal line
24 computer
25 position sensor
26 camera
27 mechanic
29 passenger
30 Internet
32 virtual cloud

What is claimed is:

1. Method of performing an automatic rescue operation of an elevator system (2), the method comprising:

(A) detecting a safety signal indicating a safety issue within the elevator system;

(B) sending data comprising information about the current state of the elevator system (2) to an external server (22);

(C) analyzing the transmitted data on the external server (22); and (D) depending on the result of the analysis, sending commands to the elevator system (2), wherein the commands include instructing the elevator system (2):

(a) to ignore the safety issue and resume normal operation of the elevator system (2), (b) to operate the elevator system (2) in a restricted rescue mode, or (c) to stop operating of the elevator system (2);

wherein the analysis of the received data is based on a model of the elevator system;

wherein the model is implemented on the external server (22);

wherein the model is configured for transferring the elevator system (2) from its current state, via at least one intermediate state, into a state allowing normal operation or into a state allowing a restricted rescue operation of the elevator system (2);

wherein steps (B) to (D) are repeated in a loop for checking whether the elevator system (2) reaches a desired intermediate state of the at least one intermediate state before the next command is sent to the elevator system (2).

2. Method according to claim 1, wherein the method further comprises the following steps to be carried out before and/or after step (C):

(E1) the external server (22) requesting further information from the elevator system (2);

(E2) the elevator system (2) sending additional data comprising further information to the external server (22); and (E3) analyzing the additionally received data on the external server (22).

3. Method according to claim 1, wherein the model includes a numerical model or a state model of the elevator system (2).

4. Method according to claim 1, wherein the data comprising information about the current state of the elevator system (2) include data indicating the state of at least one switch or node, in particular of at least one safety switch or safety node (12), of the elevator system (2).

5. Method according to claim 1, wherein the restricted rescue mode includes moving the elevator car (6) with reduced speed or for a limited distance, in particular moving the elevator car (6) to the next landing (8) and opening doors (10, 11) of the elevator car (6) and of the hoistway (4).

6. Automatic elevator safety system (1) including:

an elevator safety circuit (17) configured for monitoring the operation of an elevator system (2) comprising at least one elevator car (6) traveling along a hoistway (4) and an elevator control (13) configured for controlling the movement of the elevator car (6); and an external server (22);

wherein at least one of the elevator control (13) and the elevator safety circuit (17) is configured for sending data comprising information about the current state of the elevator system (2) to the external server (22), in particular in case a safety issue has been detected;

wherein the external server (22) is configured for (A) receiving the data sent by the at least one elevator safety circuit (17);

(B) analyzing the received data; and (C) depending on the result of the analysis, sending commands to the elevator system (2), wherein the commands include instructing the elevator system (2):

(a) to ignore the safety issue and to resume normal operation of the elevator system (2);

(b) to operate the elevator system (2) in a restricted rescue mode; or (c) to stop operating the elevator system (2);

wherein the external server is configured for analyzing the received data based on a model of the elevator system;

wherein the model is implemented on the external server (22);

wherein the model is configured for transferring the elevator system (2) from its current state, via at least one intermediate state, into a state allowing normal operation or into a state allowing a restricted rescue operation of the elevator system (2);

wherein the server (22) is configured for repeating steps (A) to (C) in a loop for checking whether the elevator system (2) has reached a desired intermediate state of the at least one intermediate state before sending the next command to the elevator system (2).

7. Automatic elevator safety system (1) according to claim 6, wherein the at least one elevator safety circuit (17) comprises a safety chain (16) including at least one mechanical switch and/or at least one electronic safety node (12), wherein the data comprising information about the current state of the elevator system (2) includes data indicating the state of the at least one safety switch and/or the at least one safety node (12).

8. Automatic elevator safety system (1) according to claim 6, wherein the external server (22) is configured for requesting further information from the elevator system (2) and analyzing the data additionally received from the elevator system (2).

9. Automatic elevator safety system (1) according to claim 6, wherein the model includes a numerical model or a state model of the elevator.

10. Automatic elevator safety system (1) according to claim 6, wherein the external server (22) is configured for receiving and analyzing data from a plurality of elevator systems (2).

11. Elevator system (2) comprising:

at least one elevator car (6) traveling along a hoistway (4) and an elevator control (13) configured for controlling the movement of the elevator car (6); and an automatic elevator safety system (1) according to claim 6.

* * * * *